United States Patent [19]

Lindström

[11] Patent Number: 4,495,726

[45] Date of Patent: Jan. 29, 1985

[54] SILL AND FRAME FOR WINDOWS OR DOORS

[75] Inventor: Wictor C. O. Lindström, Furulund, Sweden

[73] Assignee: Credence Finance Association, St. Mary, Channel Islands

[21] Appl. No.: 440,165

[22] Filed: Nov. 8, 1982

[30] Foreign Application Priority Data

Nov. 9, 1981 [SE] Sweden ..... 8106614

[51] Int. Cl.[3] ..... E05D 7/00

[52] U.S. Cl. ..... 49/401; 49/501; 49/DIG. 1

[58] Field of Search ..... 49/501, DIG. 1, 400, 49/401

[56] References Cited

FOREIGN PATENT DOCUMENTS

| | | |
|---|---|---|
| 2823317 | 12/1978 | Fed. Rep. of Germany ... 49/DIG. 1 |
| 2930539 | 3/1981 | Fed. Rep. of Germany ... 49/DIG. 1 |
| 2100177 | 2/1972 | France . |
| 496540 | 7/1954 | Italy ..... 49/401 |
| 99257 | 1/1962 | Norway . |
| 387996 | 9/1976 | Sweden . |
| 1274927 | 5/1972 | United Kingdom . |
| 1353464 | 5/1974 | United Kingdom . |
| 21483983 | 8/1977 | United Kingdom . |
| 2023208 | 12/1979 | United Kingdom . |
| 2029877 | 3/1980 | United Kingdom . |
| 2032497 | 5/1980 | United Kingdom . |
| 2065207 | 6/1981 | United Kingdom . |
| 21603435 | 11/1981 | United Kingdom . |
| 2081790 | 2/1982 | United Kingdom . |

*Primary Examiner*—Kenneth Downey

*Attorney, Agent, or Firm*—Schwartz, Jeffery, Schwaab, Mack, Blumenthal & Koch

[57] ABSTRACT

A sill and frame for windows or doors have front and rear sections and connecting elements therebetween to which the sections are connected. In order to produce the sill and frame at substantially lower costs than for conventionally manufactured sections and in a manner that saves material, each section has been formed by roll forming to provide two shanks which provide a double-walled support portion for mounting seals or build-up sections for seals. The shanks, in connection with the support portion, are extended to form coupling portions for connecting the shanks to the connecting elements.

11 Claims, 6 Drawing Figures

SILL AND FRAME FOR WINDOWS OR DOORS

BACKGROUND OF THE INVENTION

The present invention relates to a sill and frame for windows or doors, whereby the sill and frame have front and rear sections and connecting means therebetween to which said sections are connected.

Sills and frames of the above type may comprise sprayed sections of aluminum. These sections have some advantageous properties but the material is expensive and so is the equipment for the manufacture of said sections, and the consumption of material is large.

SUMMARY OF THE INVENTION

The object of the present invention is to eliminate these drawbacks and provide a sill and frame at substantially lower costs than for sprayed or otherwise manufactured sections. This is arrived at according to the invention while the sill and frame have been given certain characterizing features defined below in claim 1.

BRIEF DESCRIPTION OF THE DRAWINGS

The invention will now be further described with reference to the accompanying drawings, in which.

DETAILED DESCRIPTION OF THE PREFERRED EMBODIMENTS

Figure 1:
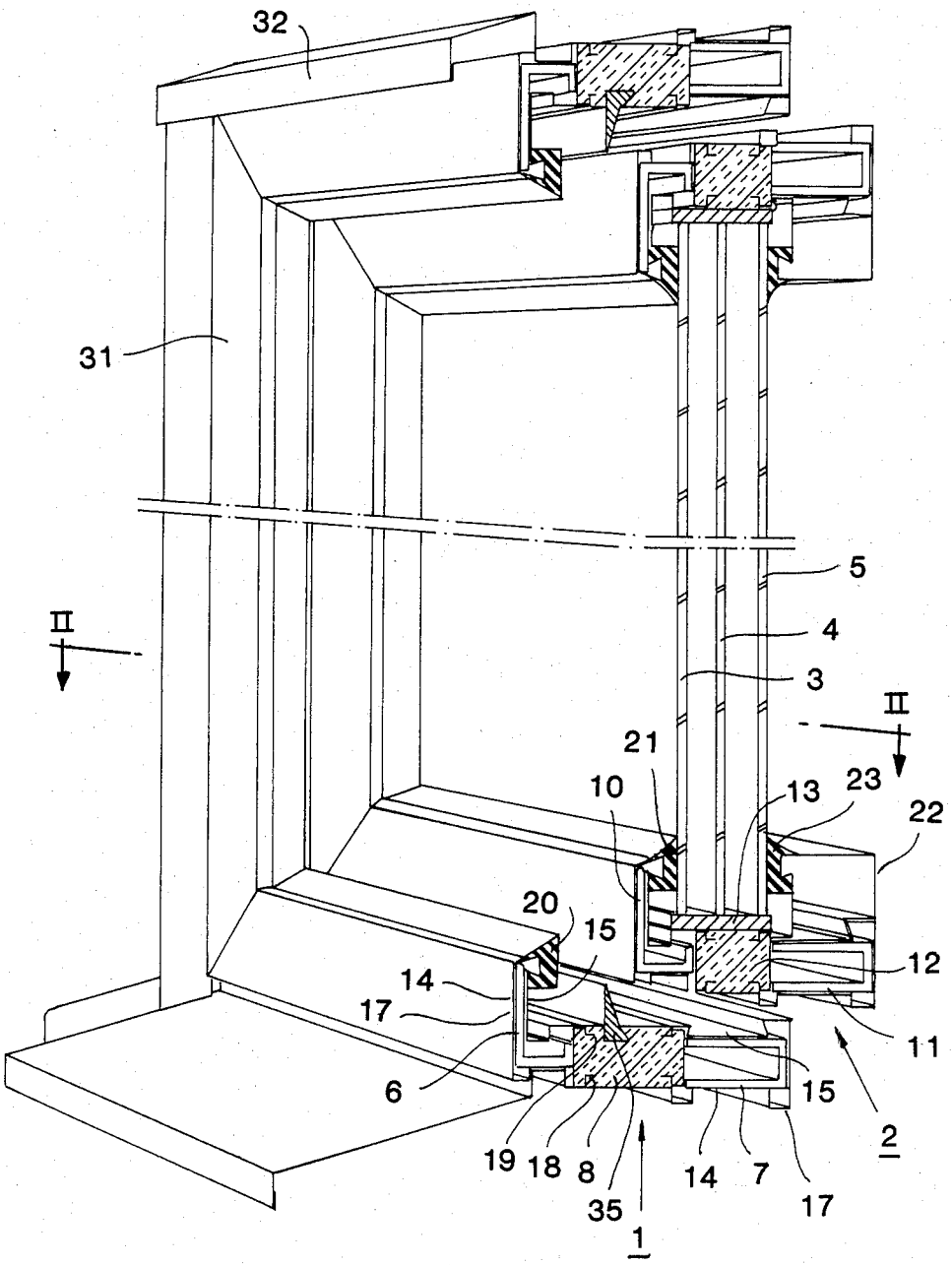
FIG. 1 is a perspective view illustrating a slightly open window, whereby the sill and frame are shown in section.

The window structure of FIG. 1 comprises a sill 1 and an inwardly moving frame 2 which is slightly open. The frame 2 has three window panes 3, 4 and 5 in order to provide a triple-glazed window.

Figure 2:
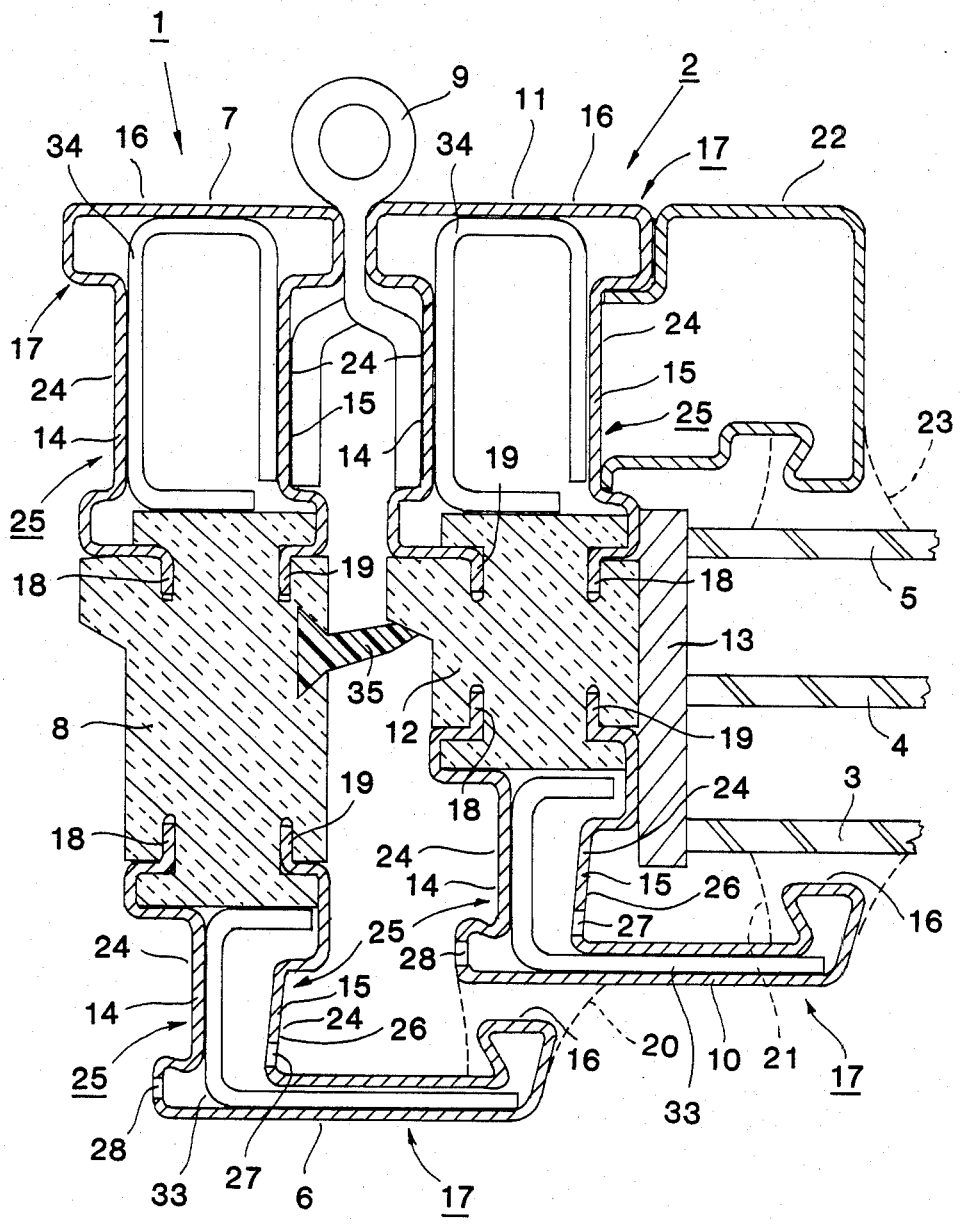
FIG. 2 is a section along line II—II in FIG. 1.

The sill 1 comprises a front section 6 and a rear profile 7 which are connected to intermediate connecting means 8 of such a material that cold transition from the front to the rear section is prevented to the highest possible extent. The frame 2 is mounted at the sill 1 by means of hinges 9 (see FIG. 2) such that it is pivotable relative to said sill. The frame 2 comprises a front section 10 and a rear profile 11 which are connected to intermediate connecting means 12 of such a material that cold transition from the front to the rear section is prevented to the highest possible extent. The window panes 3, 4 and 5 are mounted in the frame 2 in a manner known per se by means of spacing means 13.

The sections 6, 7, 10 and 11 are made by roll forming planar and preferably surface treated metal strips in preferably unheated condition, to provide two shanks 14 and 15 which are connected to each other through a transition portion 16. Closest to said transition portion 16, the shanks 14, 15 form a double-walled support portion 17 and they transform into coupling portions 18 and 19 through which the sections 6, 7, 10 and 11 are connected to said connecting means 8, 12. The double-walled support portions 17 have different shape in different sections, depending on what they shall support.

At the front sill section 6, the support portion 17 shall support sealing means 20 (see FIG. 1) which will engage the outer side of the front frame section 10. At the front frame profile 10, the support portion 17 will provide a support for sealing means 21 (see FIG. 1) which will engage the pane 3. At the rear frame section 11, the support portion 17 shall support a build-up section 22 which in turn holds sealing means 23 (see FIG. 1) clamped against the pane 5. At all sections 6, 7, 10 and 11, the support portion 17 also contributes in stiffening each section and at the rear sill profile 7, the support portion 17 provides support to the hinge 9.

In order to e.g. stiffen the sections 6, 7, 10, 11 and at the same time obtain the highest possible number of support sections, the double-walled support portion 17 extends transverse to the section part 24 formed by the shanks 14, 15 closest to the coupling portions 18, 19. At the front sections 6, 10, the support portion 17 is extended at one side, whereby said support portion 17 and said section part 24 form a substantially L-shaped section which extends somewhat over the front frame section 10 and the window pane 3 lying within thereof.

At the rear sections 7, 11, the support portion 17 and the section part 24 form a substantially T-shaped section which is suitable for various support and retainment purposes.

At all sections 6, 7, 10, 11, the support portion 17 and the coupling portions 18, 19 and intermediate portions of the shanks 14, 15 define slots 25 for application of various units, e.g. build-up sections or hinges.

At the front portions 6, 10, the shank portion 14 between the support portion 17 and the coupling portion 18 is inclined for providing a water channel 26 having drainage apertures 27. The water flowing through the aperture 27 into the profile may be discharged through drainage apertures 28 in the other shank 15.

An essential advantage in forming the profiles by roll forming is that all sections 6, 7, 10, 11 and also the profile 22 may be produced without changing the position and/or number of roll bodies in the roll forming machine. Also, quick and cheap adjusting movements may be realized by using identical sections. Thus, in the embodiment according to FIGS. 1 and 2, the front profiles 6, 10 are identical and so are the rear sections 7, 11. This means that the entire sill 1 and frame 2 can be manufactured by adjusting the roll forming machine only once and then once again for making the build-up section 22. The rear edges of the rear sections 7, 11 extend in the same plane but the front sides of the front sections 6, 10 in different planes, while the width of the connecting means 8 is larger than the width of the connecting means 12.

Figure 3:
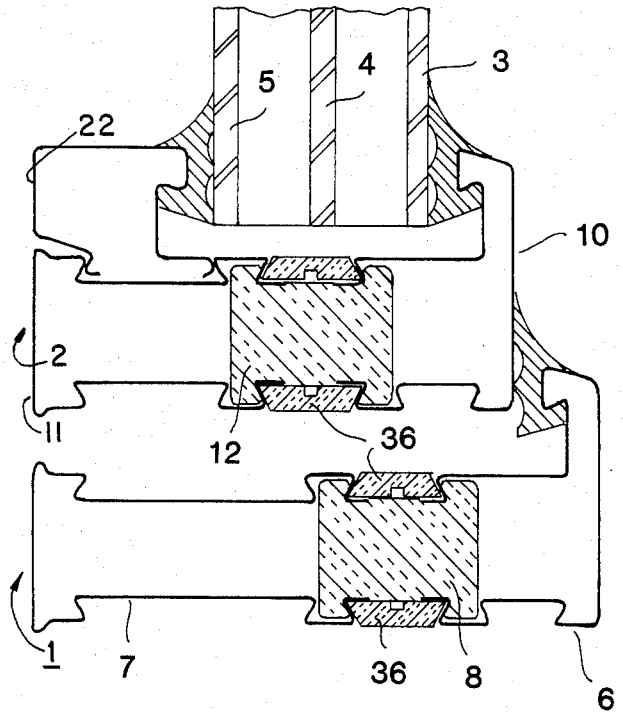
FIG. 3 is a section through a sill and frame according to a first embodiment.

In the embodiment of FIG. 3, the front sections 6, 10 are identical, while the rear sections have different length but are otherwise identical. Here, the connecting means 8, 12 are identical which facilitates the manufacture thereof.

Figure 4:
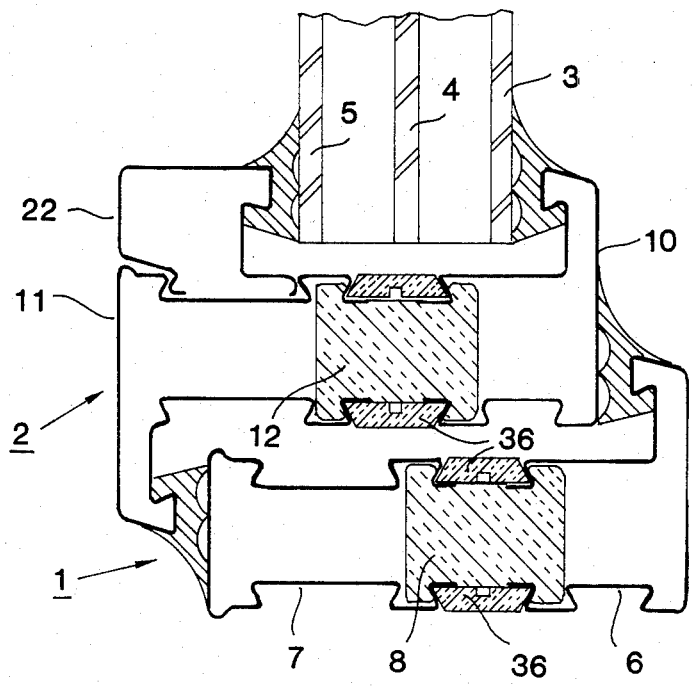
FIG. 4 is a section through a sill and frame according to a second embodiment.
Figure 5:
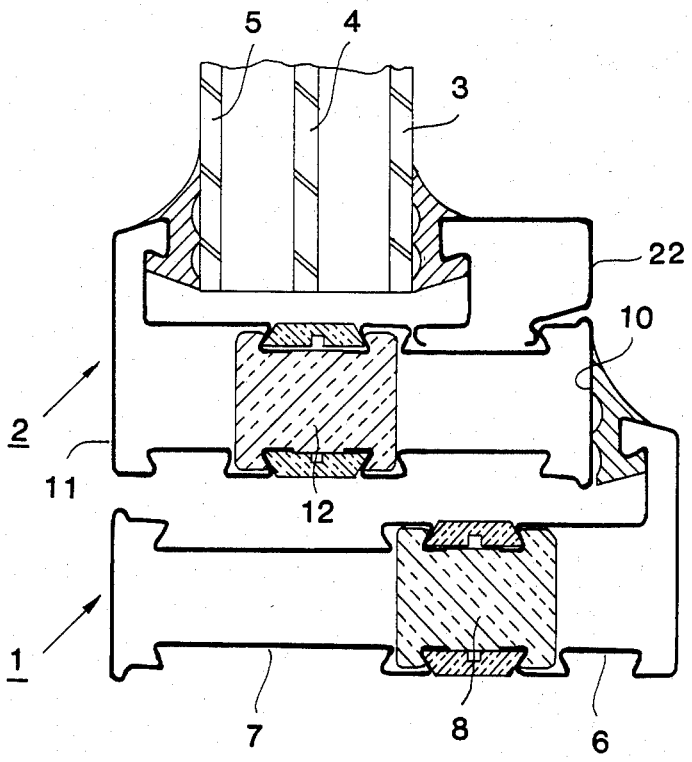
FIG. 5 is a section through a sill and frame according to a third embodiment.

In the embodiment according to FIG. 4, both the front sections 6, 10 and the rear frame section 11 are identical, while the rear sill section 7 has another shape and in the embodiment of FIG. 5, the front sill section 6 and the rear frame section 11 are identical, while the rear sill section 7 and the front frame section 10 have different length but otherwise the same shape.

Figure 6:
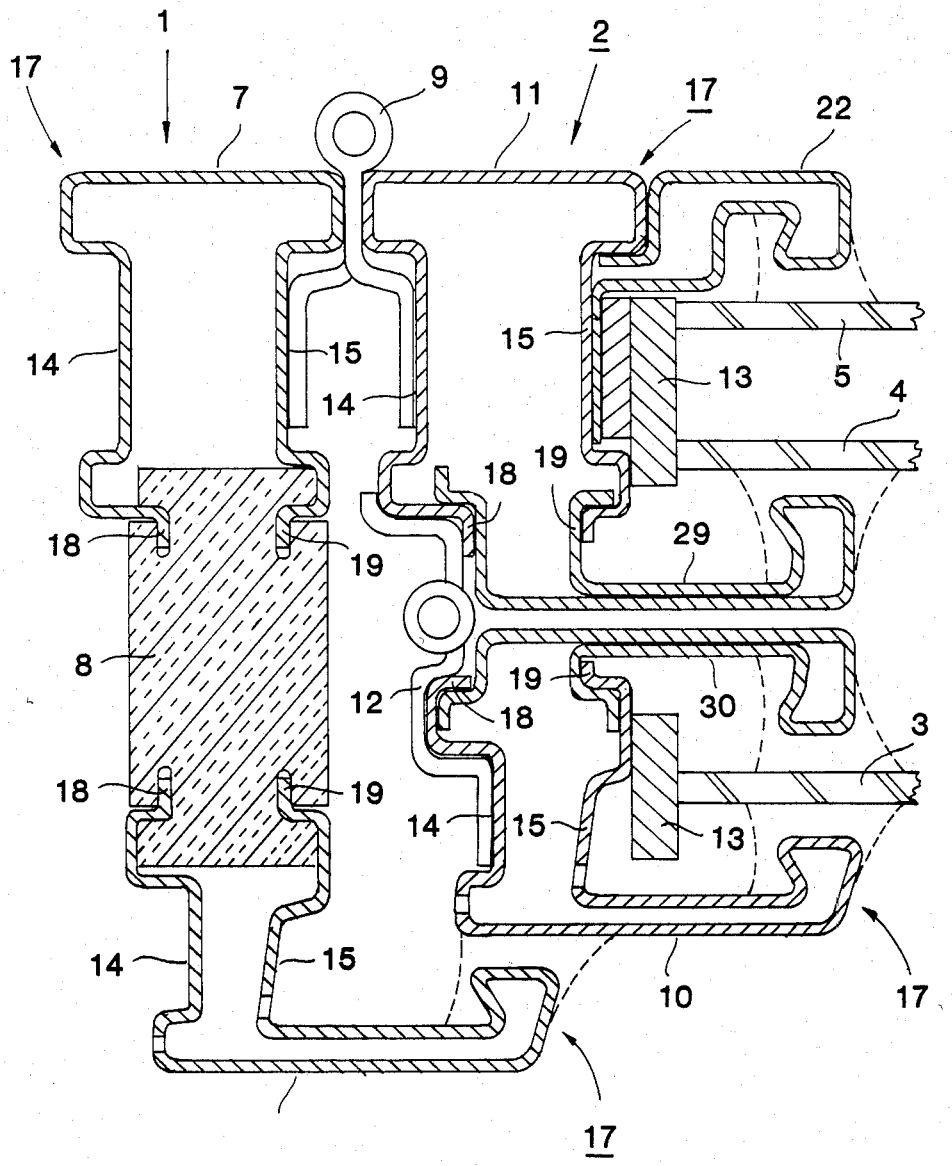
FIG. 6 is a section through a sill and frame according to a fourth embodiment.

The embodiment of FIG. 6 is an alternative with double-glazed window. Here, the rear section 11 and front section 10 of the frame 2 are connected to each other through connecting means 12 comprising a hinge, such that the front frame section 10 and its window pane 3 may pivot relative to the rear frame section 11 and its panes 4, 5.

At the coupling portions 18, 19 of the frame sections 10, 11, build-up sections 29, 30 have been mounted which provide support for sealing means (not shown) engaging the inner side of the pane 3 and the outer side of the pane 4.

Also the build-up elements 29, 30 are made in a roll forming process and they have several identical portions for facilitating the adjustment procedure during manufacture.

As is evident from the illustrated embodiments, the various sections have similar portions, if not identical.

Thus, all front and rear sections in the sill and frame may have similar or identical coupling portions 18, 19. Hereby, the adjustment procedure during roll forming is facilitated, while the same roll units for forming the coupling portions 18, 19 may be used for all these sections and also the mutual positions thereof may be maintained.

The illustrated sill and frame construction also comprises cover sections 31 and 32, reinforcing sections 33 and 34 and sealing strips 35 along with other details of wellknown type and function, e.g. details for mounting the sill in the surrounding wall.

The sill and frame 1, 2 may also be used for doors, the frame 2 may have one, two, three or more window panes, the connecting means 8, 12 may comprise a long section or several section members, the support portions 17 may be used as supports for other means than the abovementioned, the slots 25 may be intended to receive parts of the hinge 9 or other units and the coupling portions 18, 19 may be S-shaped or have another shape and fit into slots in the connecting means 8, 12 or being retained thereto by special brackets 36.

I claim:

1. A sill and frame construction for windows or doors comprising:

a sill;

a frame;

each of said sill and said frame having front and rear sections, and connecting means for connecting said front section to said rear section;

wherein each of said sections is formed by roll forming and comprises two shanks and a transition portion connecting the shanks to each other, said shanks being disposed close to each other in proximity to said transition portion to provide a double-walled support portion for retainment of a seal and wherein said shanks are extended from the support portion into coupling portions for connecting said shanks to said connecting means.

2. A sill and frame according to claim 1, wherein the double-walled support portion extends transverse to the coupling portions.

3. A sill and frame according to claim 2, wherein the double-walled support portion and the coupling portions together define an L-shaped section.

4. A sill and frame according to claim 2, wherein the double-walled support portion and the coupling portions together define a T-shaped section.

5. A sill and frame according to claim 1, wherein the double-walled support portion and the coupling portions together define slots for anchorage of build-up sections.

6. A sill and frame according to claim 1, wherein one of said shanks forming the coupling portions defines a water channel with an inclined bottom having drainage apertures, while the other shank forming the coupling portions has drainage apertures for discharge of water from the interior of the section.

7. A sill and frame according to claim 1, wherein all sections of said construction have identical coupling portions.

8. A sill and frame according to claim 1, including at least one hinge connecting different sections of said construction.

9. A sill and frame according to claim 8, wherein said hinges project into slots defined by shank parts between support portions and coupling portions.

10. A sill and frame according to claim 1, wherein the profiles have each been bent from a single piece of flat material by cold roll forming.

11. A sill and frame according to claim 1, wherein all sections have identical coupling portions, at least two sections have identical support portions and at least two sections are L-shaped and the other sections are T-shaped.

* * * * *